US005177494A

United States Patent [19]

Dörrie et al.

[11] Patent Number: 5,177,494

[45] Date of Patent: Jan. 5, 1993

[54] VEHICULAR SLOT ANTENNA SYSTEM

[75] Inventors: Horst Dörrie; Uwe Militz, both of Berlin, Fed. Rep. of Germany

[73] Assignee: Robert Bosch GmbH, Stuttgart, Fed. Rep. of Germany

[21] Appl. No.: 687,071

[22] Filed: Apr. 17, 1991

Related U.S. Application Data

[63] Continuation of Ser. No. 460,743, Jan. 4, 1990, abandoned.

[30] Foreign Application Priority Data

Feb. 16, 1989 [DE] Fed. Rep. of Germany ..... 3904676

[51] Int. Cl.[5] ..... H01Q 1/32; H01Q 13/10

[52] U.S. Cl. ..... 343/711; 343/713; 343/767

[58] Field of Search ..... 343/711, 712, 713, 767, 343/768, 771, 853

[56] References Cited

U.S. PATENT DOCUMENTS

| | | | |
|---|---|---|---|
| 2,923,813 | 2/1960 | Davis | 343/712 |
| 3,210,766 | 10/1965 | Parker | 343/712 |
| 3,662,392 | 5/1972 | Stapleton et al. | 343/768 |
| 3,794,997 | 2/1974 | Iwatsuk et al. | 343/712 |
| 4,006,481 | 2/1977 | Young et al. | 343/770 |
| 4,107,680 | 8/1978 | Kaplan | 343/717 |
| 4,638,323 | 1/1987 | Shnitkin et al. | 343/771 |
| 4,791,424 | 12/1988 | Pore | 343/711 |
| 4,845,506 | 7/1989 | Shibata et al. | 343/717 |

FOREIGN PATENT DOCUMENTS

| | | | |
|---|---|---|---|
| 0261762 | 3/1988 | European Pat. Off. . | |
| 79504 | 6/1980 | Japan | 343/717 |

*Primary Examiner*—Michael C. Wimer

*Attorney, Agent, or Firm*—Frishauf, Holtz, Goodman & Woodward

[57] ABSTRACT

To provide for ominidirectional reception/transmission of slot antennas installed on a vehicle, a plurality of slot antenna units (12, 13, 13a, 14) are installed on the vehicle, facing, for example, forwardly, rearwardly and laterally of the vehicle. Each of the slot antenna units is connected to a common feed point (28) which is coupled to a radio equipment, which may be a transmitter or receiver, by a connecting cable which has a length of $n.\lambda/2$, wherein n is a whole integer and $\lambda$ is the average operating wave length for which the antenna is designed. For about 500 MHz, an antenna length of about 55 cm with a slot length of 35 cm and a width of about 7 mm is suitable. The antenna can be formed in U shape and function as a license plate holder for, for example, a license plate made of insulating material. The antenna units are insulated from the body of the vehicle.

15 Claims, 1 Drawing Sheet

Fig. 1
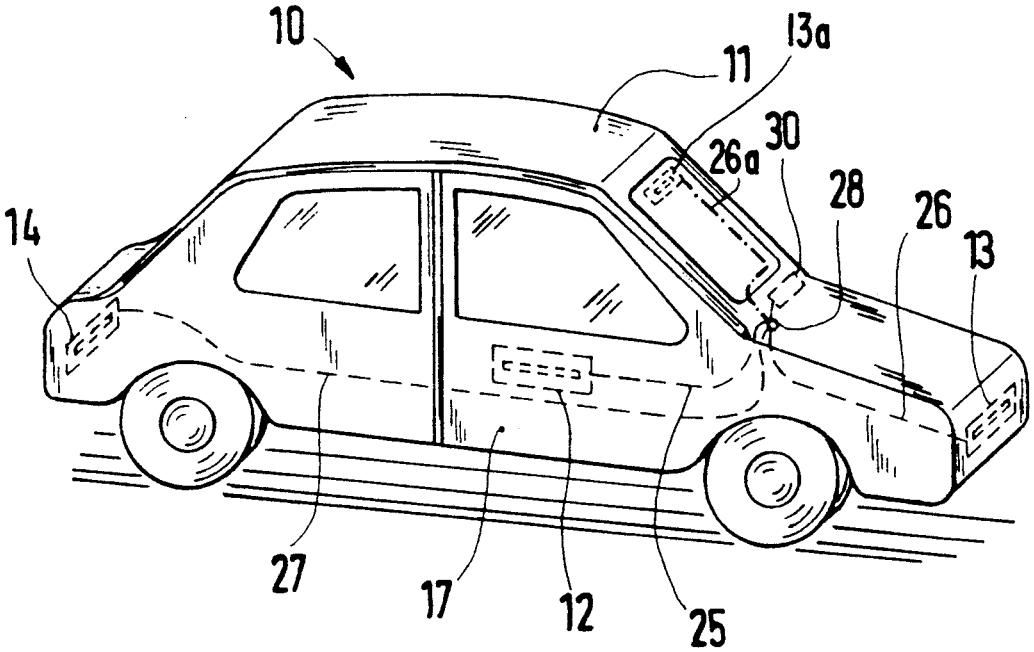
Fig. 2
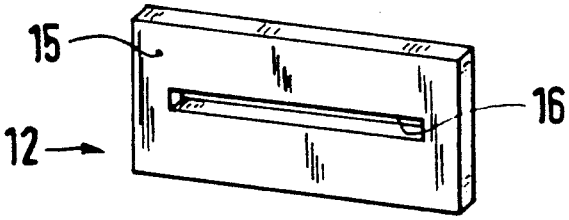
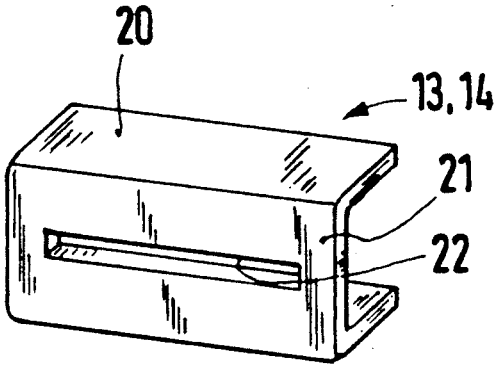
Fig. 3
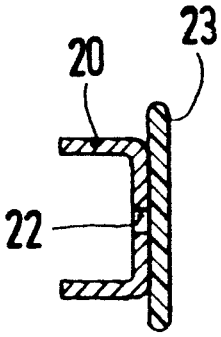
Fig. 4

VEHICULAR SLOT ANTENNA SYSTEM

This application is a continuation-in-part, of application Ser. No. 07/460,743, filed Jan. 4, 1990, now abandoned.

FIELD OF THE INVENTION

The present invention relates to an antenna system, and more particularly to an antenna system which is to be installed on a vehicle and which can pick up or radiate signals in an essentially omnidirectional pattern.

BACKGROUND

A vehicular slot antenna has been described in the referenced European Patent Application EP 0 261 762, Nagy et al, in which a slot antenna is located in the roof of a vehicle. The slot antenna is designed both for amplitude-modulated (AM) and frequency-modulated (FM) reception. These signals, in accordance with governmental regulations, have a predetermined direction of polarization. An antenna located in the roof is highly direction-dependent which, in a moving vehicle, is undesirable.

THE INVENTION

It is an object to provide an antenna system in which the advantage of slot antennas can be used which, however, is essentially direction-independent, that is, permits essentially omnidirectional reception or provides for essentially omnidirectional radiation (when the antenna is connected to a transmitter), so that the signals being received or transmitted are essentially independent of the geographical orientation of the vehicle, in which the antenna is installed.

Briefly, at least two, and preferably more antenna elements or antenna units are located on the body of the vehicle at respectively spaced locations from each other. Each one of the antenna units is connected by an antenna cable connection to a central feed point, for example the "antenna" terminal of a radio receiver or a transmitter. Each of the antenna cables has a length of $n \cdot \lambda/2$, wherein $\lambda$ is the average or median operating wave length with which the antenna is to be used, and n is a whole integer. For a frequency of about 500 MHz, an antenna length of about 55 cm with a slot length of about 35 cm and a slot width of about 7 mm is suitable.

The antenna system has the advantage that it can be used both as a transmitting as well as a receiving antenna with approximately uniform circular or omnidirectional characteristics. The antenna elements of the system can be located on the vehicle so that it is they are not visible from the outside, and so that they cannot be stolen and removed from the vehicle, and their presence does not indicate the presence of radio equipment in the vehicle. The antenna system can be readily so constructed that it is immune to external influences and, for example, will not be damaged in any way if the vehicle is washed, including being washed and scrubbed in a power vehicle washing and scrubbing bay.

DRAWINGS

FIG. 1 is a perspective view of a vehicle with a slot antenna system in accordance with the present invention installed therein;

FIG. 2 is a perspective view of a slot antenna element;

FIG. 3 is a perspective view of a different type of slot antenna element, suitable, for use, in combination with a license plate holder; and FIG. 4 is a cross-sectional view of the slot antenna of FIG. 3 to which a license plate is attached.

DETAILED DESCRIPTION

FIG. 1 shows, in highly schematic view, a passenger car 10 having a metallic body 11. Three slot antenna units or elements 12, 13 and 14 are located on the body of the vehicle, insulated from the body. Slot antenna units 12, for example, may have the shape shown in FIG. 2. The slot antenna 12 is a flat, essentially rectangular sheet metal element 15 having a longitudinal slot 16 therein. This slot antenna can be located on or in a side door 17 of the vehicle 10.

The slot antennas units 13 and 14, both, may have the shape shown in FIGS. 3 and 4. As best seen in FIG. 3, they include an essentially channel-shaped, or U-shaped sheet metal element 20, having a base 21 which is formed with a longitudinal slot 22. The slot antenna 13 or 14 can be located at the forward and/or rear portion of the vehicle, and each one of the slot antenna elements 13, 14 can carry a license plate 23 of insulating material for the vehicle, see FIG. 4. A fourth slot antenna **13*a*** can be located on the windshield.

The four slot antenna units 12, 13, 14, **13*a* are connected by respective antenna cables, preferably coaxial cables, 25, 26, 27, 26*a* to a central connection point 28, which is coupled to the antenna terminal of a radio apparatus. The connection point 28 at which the cables are connected together, see FIG. 1, may be an output terminal for a transmitter, or the input terminal for a radio or, generally, the antenna terminal of any kind of radio equipment, such as a transceiver, for example. The radio apparatus is only shown schematically at 30**.

In accordance with a feature of the invention, cables 25, 26, 27 and **26*a* are so dimensioned that they have a length $n \cdot \lambda/2$, in which n is a whole number and $\lambda$ is the average wave length. The slot antennas 12, 13, 14, 13*a* can be connected electrically in parallel, or in series. Three slot antennas are usually all that is necessary, and, therefore, the window antenna 13*a* may not be required and the connecting cable 26*a* is, therefore, shown only in chain-dotted lines. Such a window antenna can be easily formed by placing a conductive coating on the window glass, the conductive coating having an insulated slot therein, for example by forming a slit in the coating and leaving the glass of the window as insulation. The window antenna could, of course, also be located on the rear window and antenna 14** may then not be needed.

For a median or average or center frequency range of about 500 MHz, the width of the slot is preferably about 7 mm, and the conductive portion of the slot antenna has a length of about 55 cm, with the slot terminating about 10 cm from the ends, resulting in a slot length of about 35 cm.

Various changes and modifications may be made within the scope of the inventive concept.

We claim:

1. In combination with an automotive vehicle (10) having a vehicle body (11), a vehicular antenna system comprising a central feed point (28) for radiating or receiving signals, said antenna system further comprising three slot antenna units (12, 13, **13*a*, 14), one (13, 13*a***) being located at a forward portion of the vehicle, a second one (14) at a rearward portion of the vehicle, and the third one (12) at an intermediate portion of the vehicle;

antenna connection cable means (25, 26, 26a, 27) coupling the respective slot antenna units to the central feed point (28) for together connecting said signals radiated or received from the at least two slot antenna units to said feed point; and wherein each of said antenna connection cable means has a length of $n \cdot \lambda/2$, wherein $\lambda$ is the wave length of the center frequency of the radiation band coupled by the antenna system, and n is a whole integer;

and wherein each one of said slot antenna units comprises an essentially planar conductive portion (15, 21) of essentially rectangular shape, with a non-conductive slot extending longitudinally of said conductive portion and symmetrically therein, and wherein said planar conductive portions of the first and second antenna units are positioned essentially transversely to a longitudinal axis of the vehicle and the third antenna unit is located essentially parallel to said longitudinal axis.

2. The system of claim 1, wherein at least one of said antenna units comprises a sheet metal element (20) formed in U or channel shape, and having a base portion (21), said base portion being formed with an elongated slot (22) therein.

3. The system of claim 1, wherein the vehicle has at least one glass window; and at least one of the slot antenna units comprises a slot antenna which includes a conductive coating on the glass of the at least one window, which conductive coating is formed with a slot therein, whereby the glass of the window in the region of the slot will form the non-conductive slot.

4. The system of claim 1, wherein at least said third antenna unit is located in a generally vertical plane.

5. The system of claim 3, wherein at least one of said antenna units comprises a sheet metal element (20) formed in U or channel shape, and having a base portion (21), said base portion being formed with an elongated slot (22) therein.

6. The system of claim 5, wherein a vehicular license plate (23) is secured to the base portion (21) of the U-shaped sheet metal element (20) and insulated from the sheet metal element (20).

7. In combination with an automotive vehicle (10) having a vehicle body (11), a vehicular antenna system comprising a central feed point (28) for radiating or receiving signals, said antenna system further comprising two slot antenna units (12, 13, 13a, 14) located on said body, and insulated from said body, each of said antenna units radiating or receiving said signals; and antenna connection cable means (25, 26, 26a, 27) coupling the respective slot antenna units to the central feed point (28) for together connecting said signals radiated or received from the two slot antenna units to said feed point; and wherein each of said antenna connection cable means has a length of $n \cdot \lambda/2$, wherein $\lambda$ is the wave length of the center frequency of the radiation band coupled by the antenna system, and n is a whole integer;

wherein a first one of the antenna units is located at an extreme portion of the vehicle and a second one of the antenna units is located at an intermediate portion of the vehicle;

said slot antenna units comprise a conductive portion (21) of essentially rectangular shape, with a non-conductive slot extending longitudinally of said conductive portion and symmetrically therein, and wherein the conductive portion of the first one of the slot antenna units is positioned essentially transversely to the longitudinal axis of the vehicle and the conductive portion of the second antenna unit is located essentially parallel to said longitudinal axis.

8. The system of claim 7, wherein one of said antenna units comprises a sheet metal element (20) formed in U or channel shape, and having a base portion (21), said base portion being formed with said non-conductive slot (22) therein.

9. The system of claim 8, wherein a vehicular license plate (23) is secured to the base portion (21) of the U-shaped sheet metal element (20) and insulated from the sheet metal element (20).

10. The system of claim 7, wherein the vehicle has at least one glass window; and at least one of the slot antenna units comprises a slot antenna which includes a conductive coating on the glass of the at least one window, which conductive coating is formed with a slot therein, whereby the glass of the window in the region of the slot will form the non-conductive slot.

11. In combination with an automotive vehicle (10) having a vehicle body (11), a vehicular antenna system comprising a central feed point (28) for radiating or receiving signals, said antenna system further comprising at least two slot antenna units (12, 13, 13a, 14) located on said body, and insulated from said body, each of said antenna units radiating or receiving said signals;

wherein one of said at least two slot antenna units is located at an angle with respect to, and spaced apart from, another one of the slot antenna units; and antenna connection cable means (25, 26, 26a, 27) are provided, coupling the respective slot antenna units to the central feed point (28) for together connecting said signals radiated or received from the at least two slot antenna units to said feed point; and wherein each of said antenna connection cable means has a length of $n \cdot \lambda/2$, wherein $\lambda$ is the wave length of the center frequency of the radiation band coupled by the antenna system, and n is a whole integer;

wherein three slot antenna units are provided, one being located at a forward portion of the vehicle, a second one at a rearward portion of the vehicle, and a third one at an intermediate portion of the vehicle;

and wherein each one of said slot antenna units comprises an essentially planar conductive portion (15, 21) of essentially rectangular shape, with a non-conductive slot extending longitudinally of said conductive portion and symmetrically therein, and wherein said planar conductive portions of the first and second antenna units are positioned essentially transversely to a longitudinal axis of the vehicle and the third antenna unit is located essentially parallel to said longitudinal axis;

and wherein at least one of said antenna units comprises a sheet metal element (20) formed in U or channel shape, and having a base portion (21), said base portion being formed with an elongated slot (22) therein.

12. The system of claim 11, wherein a vehicular license plate (23) is secured to the base portion (21) of the U-shape sheet metal element (20) and insulated from the sheet metal element (20).

13. The system of claim 11, wherein the vehicle has at least one glass window; and at least one of the slot antenna units comprises a slot antenna which includes a conductive coating on the glass of the at least one window, which conductive coating is formed with a slot therein, whereby the glass of the window in the region of the slot will form the non-conductive slot.

14. The system of claim 11, wherein said angle is essentially a right angle.

15. The system of claim 13, wherein said angle is essentially a right angle.

* * * * *